US006168158B1

(12) United States Patent
Bulsink

(10) Patent No.: US 6,168,158 B1
(45) Date of Patent: Jan. 2, 2001

(54) DEVICE FOR DETECTING PLAYING PIECES ON A BOARD

(75) Inventor: Bernard Johan Bulsink, Enschede (NL)

(73) Assignee: DGT Projects B.V., Enschede (NL)

( * ) Notice: Under 35 U.S.C. 154(b), the term of this patent shall be extended for 0 days.

(21) Appl. No.: 09/345,593

(22) Filed: Jun. 30, 1999

(30) Foreign Application Priority Data

Jul. 6, 1998 (NL) ..... 1009574

(51) Int. Cl.[7] ..... A63F 3/00
(52) U.S. Cl. ..... 273/237; 273/238
(58) Field of Search ..... 273/236, 237, 273/309, 238

(56) References Cited

U.S. PATENT DOCUMENTS 3,974,425 * 8/1976 Ueda et al. .
4,039,036 * 8/1977 Baumgartner et al. .
4,277,750 * 7/1981 Bonnet et al. .
5,129,654 * 7/1992 Bogner .
5,188,368 * 2/1993 Ryan .

FOREIGN PATENT DOCUMENTS 0416955 3/1991 (EP) .
2103943 3/1983 (GB) .
9211909 7/1992 (WO) .

* cited by examiner

*Primary Examiner*—Mark S. Graham
*Assistant Examiner*—V K Mendiratta

(74) *Attorney, Agent, or Firm*—Webb Ziesenheim Logsdon Orkin & Hanson, P.C.

(57) ABSTRACT

The invention relates to a game device, comprising:

a game board divided into discrete squares and pieces of differing type for placing on these squares, such as a chessboard and chess pieces, wherein the squares are ordered in a rectangular array comprising rows and columns of squares, which game device comprises detection means for detecting the possible presence and the type of a piece on each square, in addition to means for generating appropriate detection signals, which device comprises:

resonance coils arranged in the playing pieces;

a number of elongate transmit and receive coils arranged in the board which each extend below a row or column of squares such that a part of both a transmit and receive coil is situated under each square;

means for successively selecting a transmit coil and a receive coil in scanning manner;

an amplifier which in correspondingly scanning manner is connected with its output to the selected transmit coil and connected with its input to the selected receive coil such that when a playing piece is situated above both the selected transmit coil and the selected receive coil a resonance signal is generated;

means for detecting the resonance signal and generating a corresponding position and type signal, wherein for each transmit and/or receive coil at least one winding serving for compensation is arranged on its closed end zone remote from the amplifier in either a transmit coil or a receive coil.

17 Claims, 3 Drawing Sheets

DEVICE FOR DETECTING PLAYING PIECES ON A BOARD

BACKGROUND OF THE INVENTION

1. Field of the Invention

The invention relates to a game device, comprising:

a game board divided into discrete squares and pieces of differing nature for placing on these squares, wherein the squares are ordered in a rectangular array comprising rows and columns of squares, which game device comprises detection means for detecting the possible presence and the type of a piece on each square, in addition to means for generating appropriate detection signals, which device comprises:

resonance coils arranged in the playing pieces, wherein a resonance coil has electrical and magnetic properties related unambiguously to the type of playing piece;

a number of elongate transmit and receive coils arranged in the board which each extend below a row or column of squares such that a part of both a transmit and receive coil is situated under each square;

means for successively selecting a transmit coil and a receive coil in scanning manner;

an amplifier which in correspondingly scanning manner is connected with its output to the selected transmit coil and connected with its input to the selected receive coil such that when a playing piece is situated above both the selected transmit coil and the selected receive coil a resonance signal is generated;

means for detecting the resonance signal and generating a corresponding position and type signal.

2. Description of the Prior Art

U.S. Pat. No. 5,188,368 describes an electronic board game, such as a chessboard, which comprises a number of playing pieces with a resonance coil, a number of transmit and receive coils, means for selecting a transmit and receive coil such that an individual playing position on the board is selected, and wherein the transmit and receive coil is connected to an amplifier such that a resonance frequency is generated which can be detected by detecting means.

A drawback of such a device is that the transmit and receive coils also generate a resonance frequency. This resonance frequency interferes with the resonance frequency of the resonance coil in a playing piece. This interference increases as the topography of the coils round the selected playing square becomes less symmetrical. The interference in the centre of the board is hereby slight and this interference increases towards the edge of the board.

In order to deal with this it is possible to cause the coils to extend a considerable distance beyond the edge of the playing surface. A drawback hereof is that the game board acquires a very wide edge.

SUMMARY OF THE INVENTION

It is an object of the present invention to overcome the above stated drawbacks.

This objective is achieved according to the invention in that for each transmit and/or receive coil at least one winding serving for compensation is arranged on at least one closed end zone in either a transmit coil or a receive coil.

In one embodiment the transmit and/or receive coils comprise a number of windings. The transmitting or receiving capacity of the coil is hereby increased, whereby the resonance frequency is simpler to detect.

In a further preferred embodiment the transmit and receive coils are arranged on a sheet, whereby an inexpensive and effective embodiment is obtained. It is also possible herein to cause electrically conducting tracks to mutually intersect by arranging insulating bridges.

In another embodiment the feed and discharge wire of each coil intersect such that interference of the coils is minimized.

BRIEF DESCRIPTION OF THE DRAWINGS

These and other features will become apparent from the description hereinbelow in combination with the drawings.

DETAILED DESCRIPTION OF THE PREFERRED EMBODIMENTS

Figure 1:
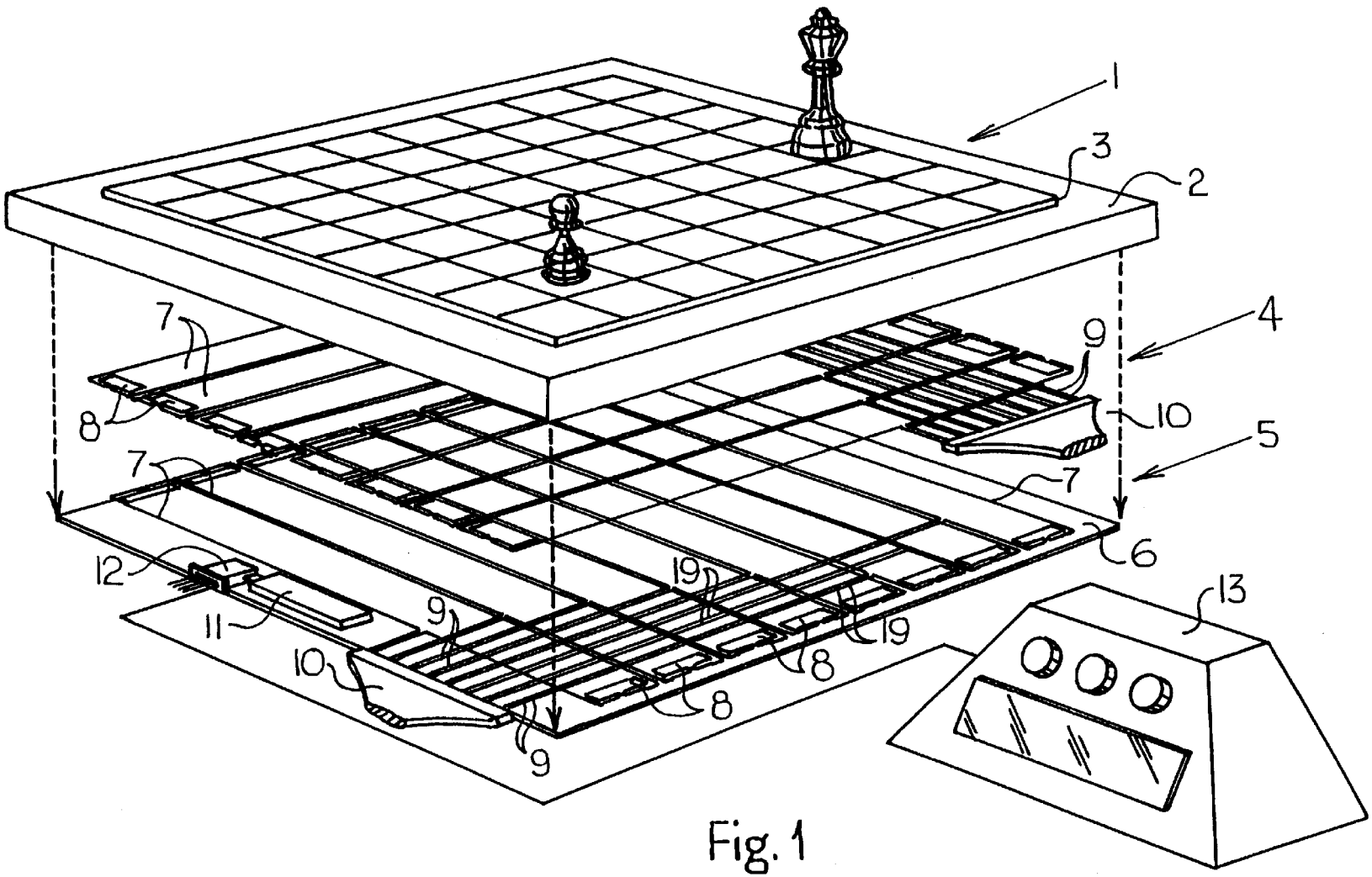
FIG. 1 shows is an exploded perspective view of one embodiment of the device according to the invention.

FIG. 1 shows a chessboard 1 embodied according to the invention. This chessboard 1 comprises an upper housing part 2 having thereon a chessboard pattern 3 and a layer of receive coils 4, a layer of transmit coils 5 and a lower housing part 6. The layer of receive coils 4 and the layer of transmit coils 5 each comprise a number of elongate coils 7 placed mutually parallel and each comprising a compensation winding 8 on both ends. Each coil 7 is connected by means of connecting wires 9 to a cable bundle 10. This cable bundle 10 is connected to control device 11. This latter comprises a connector 12 for communication between chessboard 1 and a processing device 13, such as a computer. Connecting wires 9 can intersect in order to reduce interference in these wires.

Figure 2:
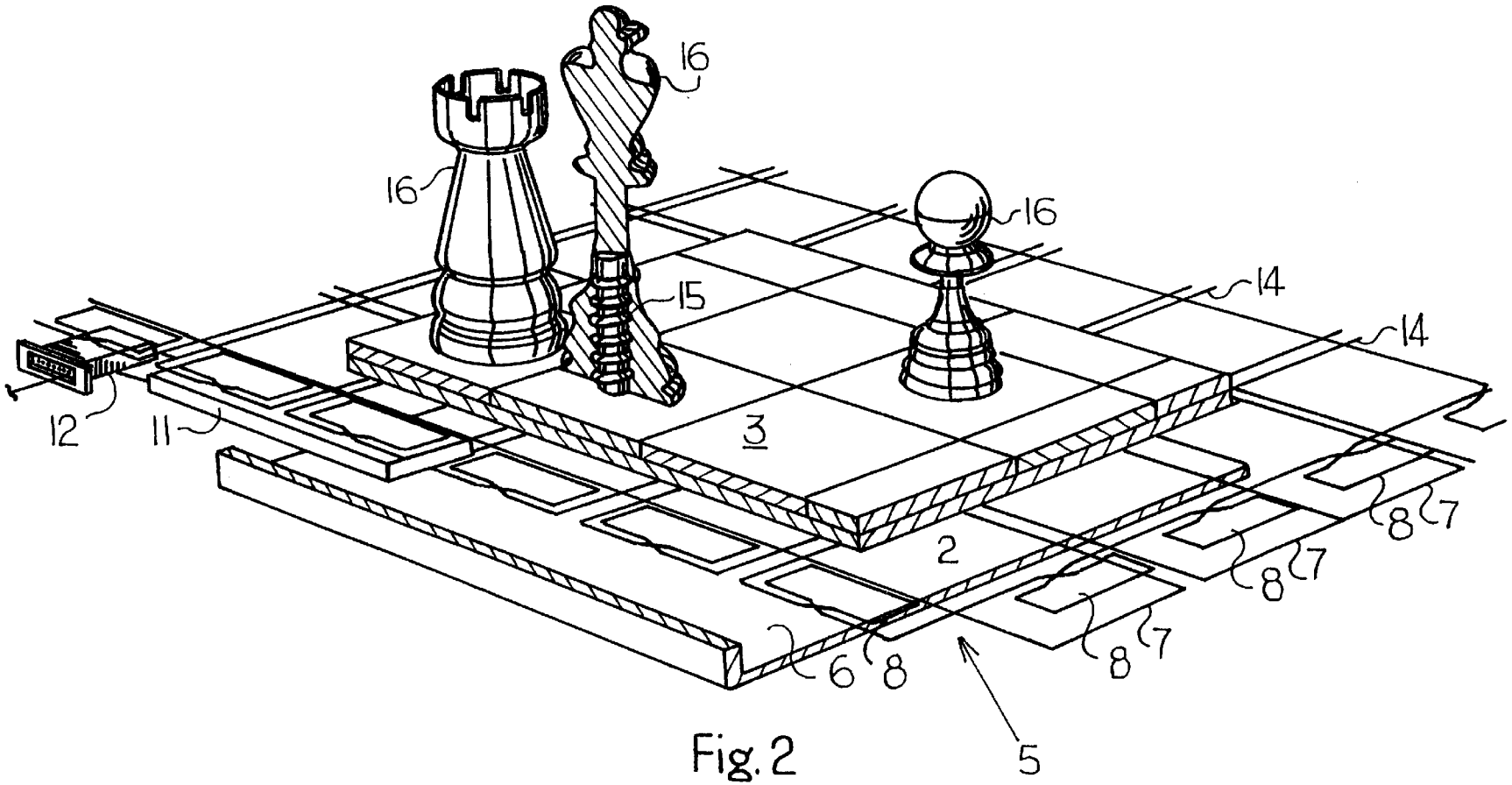
FIG. 2 shows a part of the embodiment of FIG. 1 in perspective view with partly cut-away parts.

FIG. 2 shows a second embodiment according to the invention, components of which having the same function are designated with the same reference numerals. A difference from the embodiment of FIG. 1 is that compensation windings 8 are only arranged in the layer of transmit coils 5. The compensation for receive coils 4 is obtained in that transmit coil 14 adjacent to the edge of the game board comprises a compensation winding 8 for each receive coil.

FIG. 2 further shows a resonance coil 15 which is received in a playing piece 16.

Figure 3:
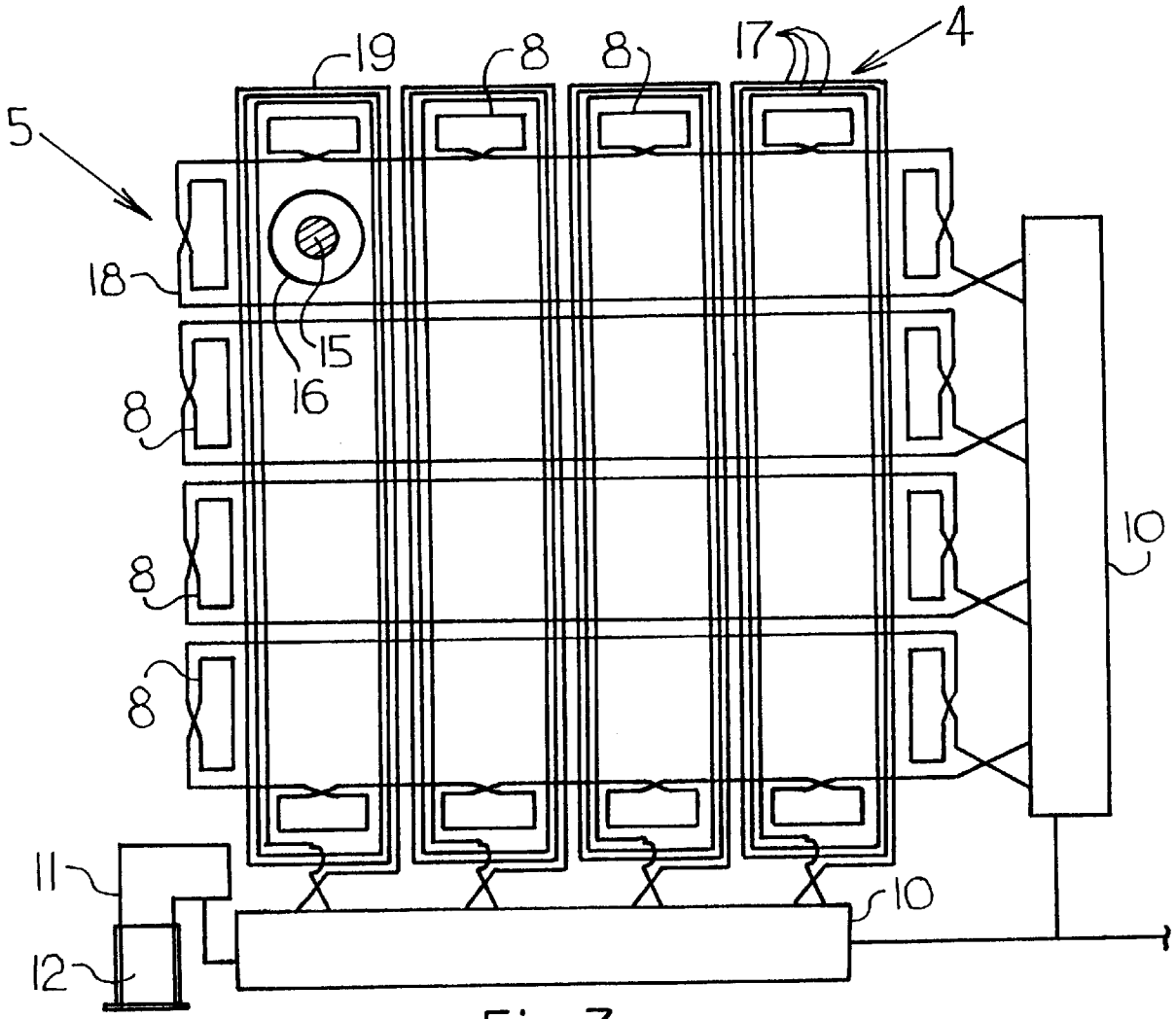
FIG. 3 shows the lay-out of the transmit and receive coils of a device according to the invention.

FIG. 3 shows a third embodiment according to the invention, wherein like components are designated with like reference numerals. The third embodiment differs from the second embodiment according to FIG. 2 in the layer of receive coils 4. Each receive coil 7 comprises a number of windings 17 whereby the sensitivity of the receive coil is increased.

The operation of a device according to the invention is as follows. Control device 11 selects a transmit coil 18 and a receive coil 19 (see FIG. 3). Transmit coil 18 is subsequently connected to the output of an amplifier arranged in control device 11 and receive coil 19 is connected to the input thereof. A resonance will occur in the circuit due to the induction between transmit coil 18 and receive coil 19. Because a playing piece 16 with a resonance coil 15 is situated above the intersecting part of transmit coil 18 and receive coil 19, resonance coil 15 of piece 16 will influence the above stated resonance such that a fixed resonance frequency results. This resonance frequency is specific to playing piece 16 and it is therefore possible hereby to determine the position of piece 16 on chessboard 1 with control device 11. Compensation windings 8 are arranged to compensate the asymmetry of the coils close to the edges. When a compensation winding is arranged in a transmit coil, this compensation winding will then generate an additional magnetic field, whereby the asymmetry of the field generated by the transmit coil close to the edge will be supplemented such that the field is practically symmetrical.

When the compensation winding is arranged in a receive coil, this latter will then detect an additional magnetic field, whereby the asymmetry of the generated field is compensated by the additional reception of the compensation winding.

Owing to these compensation windings the detected magnetic field close to the edge of the game board will be practically symmetrical, similarly to a magnetic field detected in the centre of the game board.

What is claimed is:

1. A game device, comprising:

a game board divided into discrete squares and pieces of differing type for placing on these squares, wherein the squares are ordered in a rectangular array including rows and columns of squares, which game device includes detection means for detecting the possible presence and the type of a piece on each square, in addition to means for generating appropriate detection signals;

resonance coils arranged in the playing pieces, wherein each resonance coil has electrical and magnetic properties related unambiguously to the type of playing piece;

a plurality of elongate transmit coils and receive coils arranged in the board and each extending below a row or column of squares such that a part of both a transmit coil and a receive coil is situated under each square;

means for successively selecting a transmit coil and a receive coil in a scanning manner;

an amplifier which in the scanning manner is connected with its output to a selected transmit coil and connected with its input to a selected receive coil such that when a playing piece is situated above both the selected transmit coil and the selected receive coil a resonance signal is generated;

means for detecting the resonance signal and generating a corresponding position and type signal; and wherein each transmit and/or receive coil includes at least one winding serving for compensation arranged between opposite ends and adjacent at least one end thereof.

2. The device as claimed in claim 1, wherein the transmit coils each include at least two windings.

3. The device as claimed in claim 1, wherein the transmit coils and receive coils are each arranged on an electrically insulating, magnetically inactive sheet.

4. The device as claimed in claim 1, including a set of two connecting wires for each transmit coil and receive coil, wherein the connecting wires of each set intersect in order to prevent interference in the receive coils.

5. The device as claimed in claim 1, wherein an outer longitudinal side of an edge of the transmit coils include compensation windings at positions corresponding with the squares.

6. The game device as claimed in claim 1, wherein the receive coils each include at least two windings.

7. The device as claimed in claim 1, wherein an outer longitudinal side of an edge of the receive coils include compensation windings at positions corresponding with the squares.

8. A game device, comprising:

a plurality of playing pieces of differing type, with each playing piece including a resonance coil having a resonance frequency related uniquely to the type of playing piece;

a game board having a playing surface defining a plurality of squares arranged into rows and columns;

a first plurality of planar coils and a second plurality of planar coils positioned relative to each other and the game board such that a part of each coil of the first plurality of coils and a part of each coil of the second plurality of coils is positioned on a side of each square opposite the playing surface, with each coil having a generally rectangular form defined by a pair of elongated sides which extend between opposite ends thereof, with the elongated sides being connected to each other only adjacent the ends of the coil; and a plurality of compensation coils, with each coil of the first plurality of coils and each coil of the second plurality of coils having at least one compensation coil positioned between opposite ends and adjacent at least one end thereof.

9. The device as claimed in claim 8, further including:

means for selectively stimulating one of the first plurality of coils with an AC signal having a frequency corresponding to the resonance frequency of at least one type of playing piece; and means for detecting from a selected one of the second plurality of coils the resonance frequency of the at least one type of playing piece in response to stimulation of the one of the first plurality of coils with the AC signal.

10. The device as claimed in claim 8, wherein each coil of the first plurality of coils includes at least two windings.

11. The device as claimed in claim 8, wherein each coil of the first plurality of coils is received on an electrically insulating, magnetically inactive sheet.

12. The device as claimed in claim 11, wherein each coil of the second plurality of coils is received on the electrically insulating, magnetically inactive sheet.

13. The device as claimed in claim 11, wherein each coil of the second plurality of coils is received on another electrically insulating, magnetically inactive sheet.

14. The device as claimed in claim 9, further including:

a first plurality of connecting wires connected in pairs between the means for stimulating and each coil of the first plurality of coils; and a second plurality of connecting wires connected in pairs between the means for detecting and each coil of the second plurality of coils, wherein the first plurality of connecting wires and the second plurality of connecting wires are arranged to avoid interference in the second plurality of coils.

15. The device as claimed in claim 8, wherein an outer side of the first plurality of coils includes compensation windings at positions corresponding with the squares.

16. The device as claimed in claim 8, wherein each coil of the second plurality of coils includes at least two windings.

17. The device as claimed in claim 8, wherein an outer side of the second plurality of coils includes compensation windings at positions corresponding with the squares.

* * * * *